US009772161B1

(12) United States Patent
Cheng

(10) Patent No.: US 9,772,161 B1
(45) Date of Patent: Sep. 26, 2017

(54) KEYMOD HANDGUARD QUICK RELEASE STRUCTURE

(71) Applicant: Chung-Tien Cheng, Alpharetta, GA (US)

(72) Inventor: Chung-Tien Cheng, Alpharetta, GA (US)

( * ) Notice: Subject to any disclaimer, the term of this patent is extended or adjusted under 35 U.S.C. 154(b) by 0 days.

(21) Appl. No.: 15/229,109

(22) Filed: Aug. 4, 2016

(51) Int. Cl.
*F41C 23/16* (2006.01)
*F41C 27/00* (2006.01)

(52) U.S. Cl.
CPC ..... *F41C 27/00* (2013.01); *F41C 23/16* (2013.01)

(58) Field of Classification Search
CPC ..... F41C 23/16; F41C 23/14; F41C 27/00
See application file for complete search history.

(56) References Cited

U.S. PATENT DOCUMENTS

2010/0126054 A1* 5/2010 Daniel ..... F41C 23/16 42/71.01
2016/0116252 A1* 4/2016 Kincel ..... F41C 27/00 42/90

* cited by examiner

*Primary Examiner* — Stephen M Johnson
(74) *Attorney, Agent, or Firm* — Baker, Donelson, Bearman, Caldwell & Berkowitz, PC; Dorian Kennedy

(57) ABSTRACT

A KeyMod handguard quick release structure is mainly used in rifle gun, including a base body for mounting gun accessories, operation elements, first spring element fixed to each operation element, a positioning element and a second spring element installed between the positioning element and base body, where the seat body has an accommodation space and through hole, the operation elements respectively have a guide portion, and the positioning element is passed through the through-hole. When the base body is to be installed on the KeyMod handguard, an engagement member is placed in a large engagement hole, and the base body is then pressed down, the positioning element being moved upward immediately.

7 Claims, 12 Drawing Sheets

KEYMOD HANDGUARD QUICK RELEASE STRUCTURE

TECHNICAL FIELD OF THE INVENTION

The present invention relates to a quick release structure for gun accessories, and more particularly to a quick release structure for mounting on or dismounting accessories from a KeyMod handguard of a rifle gun quickly.

DESCRIPTION OF THE PRIOR ART

The current KeyMod handguards are very popular. Many accessories such as sights, laser sights, flashlights and bipods, can be attached to KeyMod handguards. In order to hit a target, gun users must be able to aim at a target accurately. Therefore, guns are usually equipped with a front and a rear sight. For speedy aiming and convenience, gun users often carry locking devices to mount additional accessories on gun bodies. Examples of such accessories are illuminators and other aiming aids. Currently, a tool like a wrench is needed to lock such accessories in place, making the operation time-consuming and cumbersome.

SUMMARY OF THE INVENTION

To overcome deficiencies and disadvantages of prior art mentioned above, the present invention is proposed.

The main objective of the present invention is to provide a quick release structure for a KeyMod handguard, allowing a base body to have a compressing-to-position effect via a combination of an operation element and a positioning element. At the same time, the base body can be engaged with and fixed to a KeyMod handguard smoothly and quickly through an embedding engagement member. The entire operation is simple and time-saving. There is no need to use any tools.

To achieve the objective mentioned above, the present invention proposes a KeyMod handguard quick release structure, including:

a base body, having an accommodation space with two through-sides and a through-hole in communication with the accommodation space;

a plurality of operation elements, movably installed in the accommodation space, and each operation element having at least one guide portion;

a plurality of first spring element, configured between the operation elements and a positioning element, passed through the through hole;

a first inclined face operated in coordination with the guide portion being formed thereon;

a second spring element, configured between the positioning element and base body; and at least one engagement member, configured on the bottom of the base body and adapted to embed in a KeyMod handguard.

Whereby, when the base body is to be installed on a KeyMod handguard, an engagement member is placed in a large engagement hole, and the base body is then pressed down, the positioning element being moved upward immediately and then, the base body can thereafter be moved toward a small engagement hole. The positioning element will be engaged with the large engagement hole while moving to the edge. The "quick release structure" is then engaged to the desired position and locked.

DETAILED DESCRIPTION OF THE PREFERRED EMBODIMENTS

Figure 1:
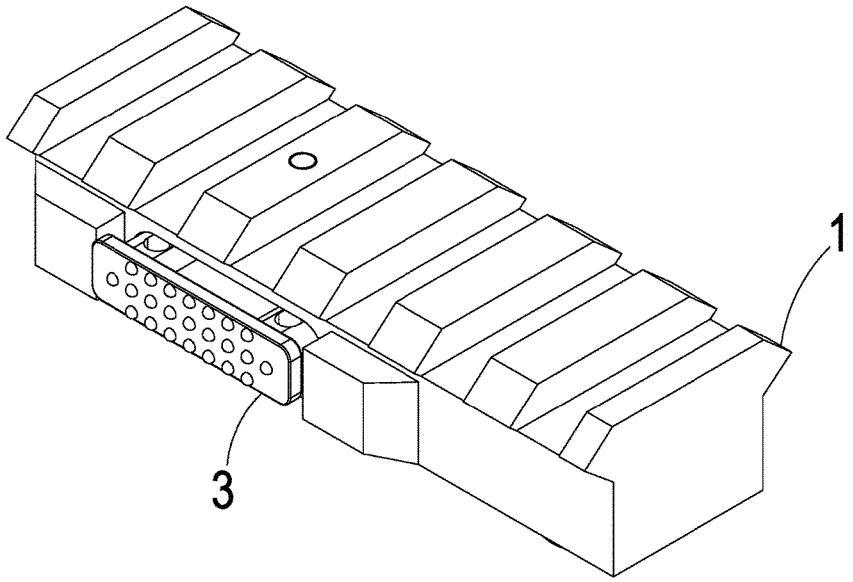
FIG. 1 is a perspective view of a preferred embodiment according to the present invention.
Figure 2:
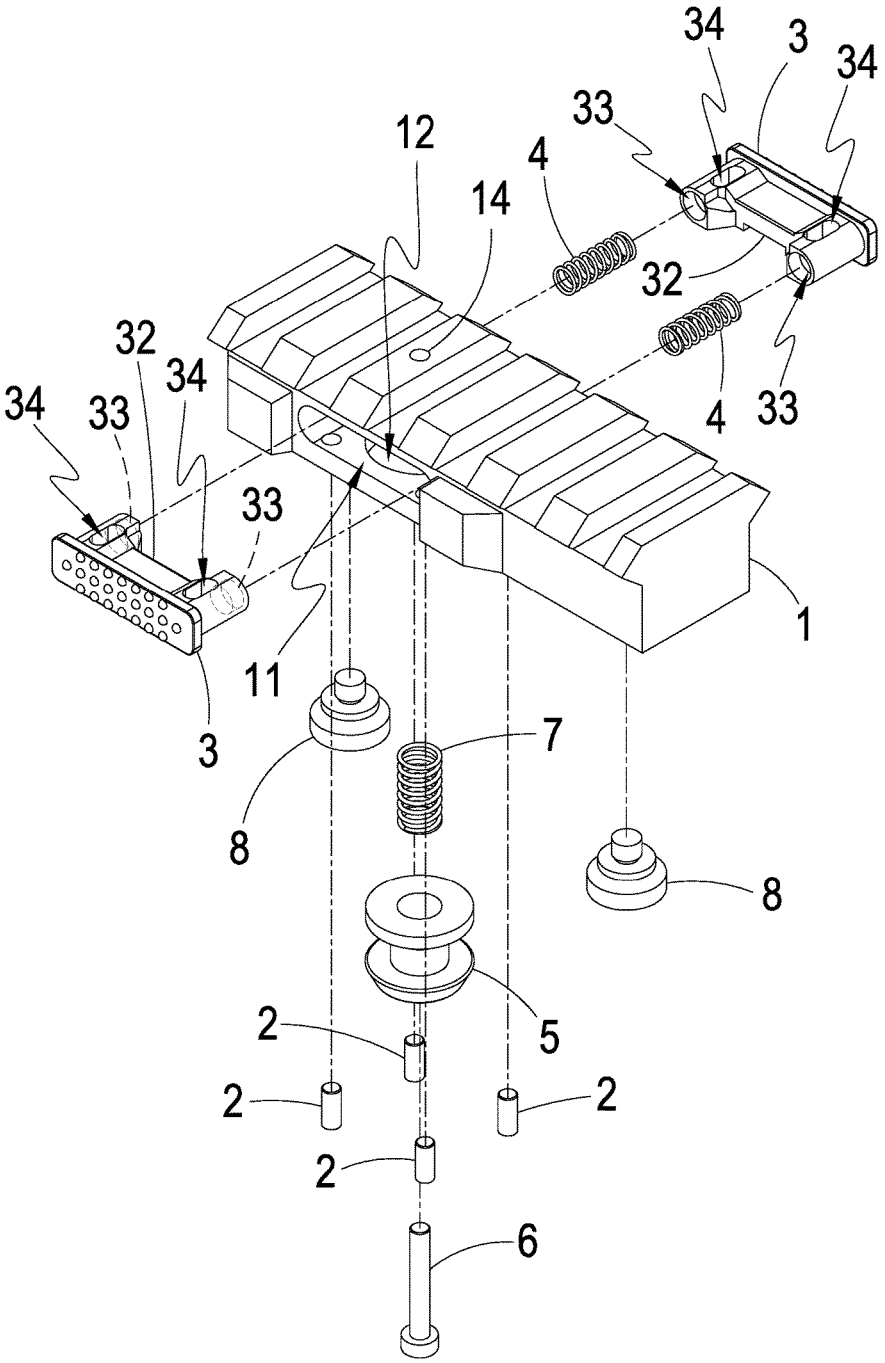
FIG. 2 is an exploded view of the embodiment of the present invention.
Figure 3:
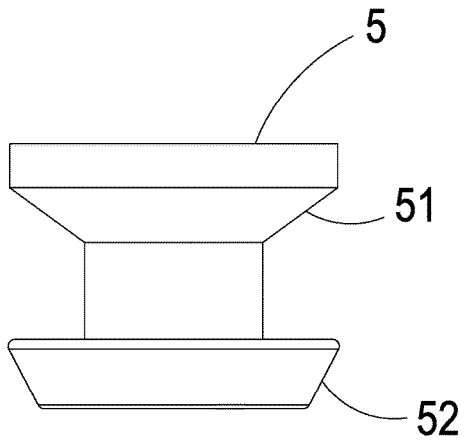
FIG. 3 is a front view of a positioning element of the embodiment of the present invention.
Figure 4:
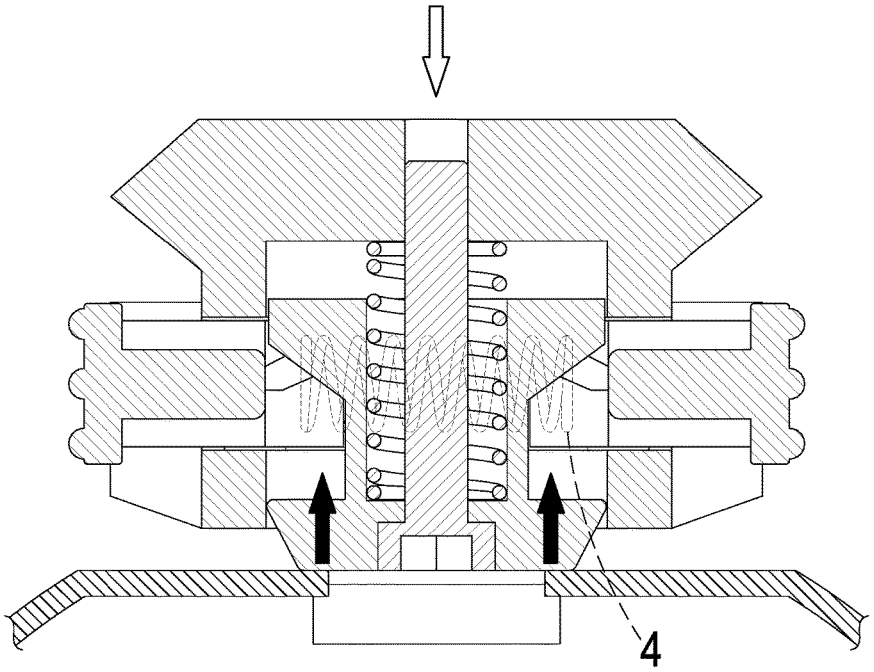
FIGS. 4 to 10, respectively, are a schematically cross-sectional view of the embodiment of the present invention in an action state.
Figure 5:
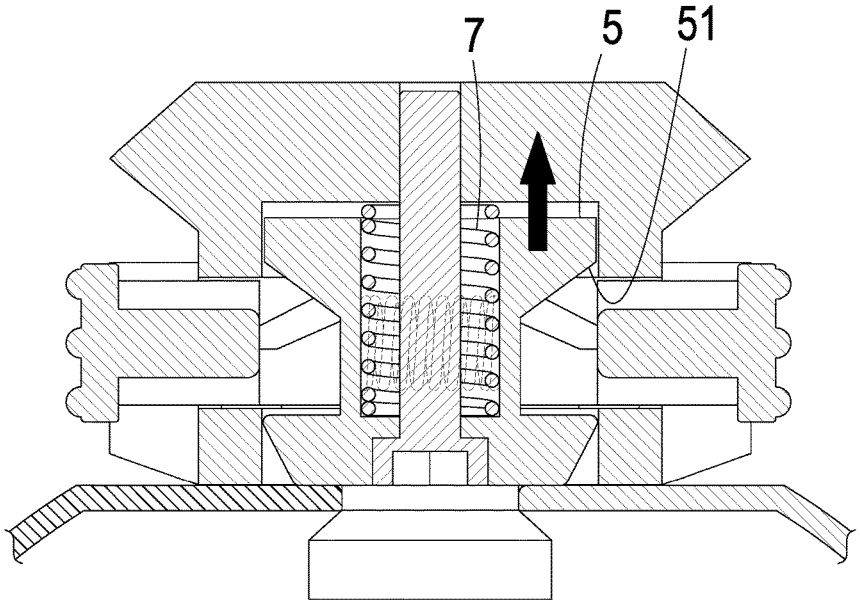
Figure 6:
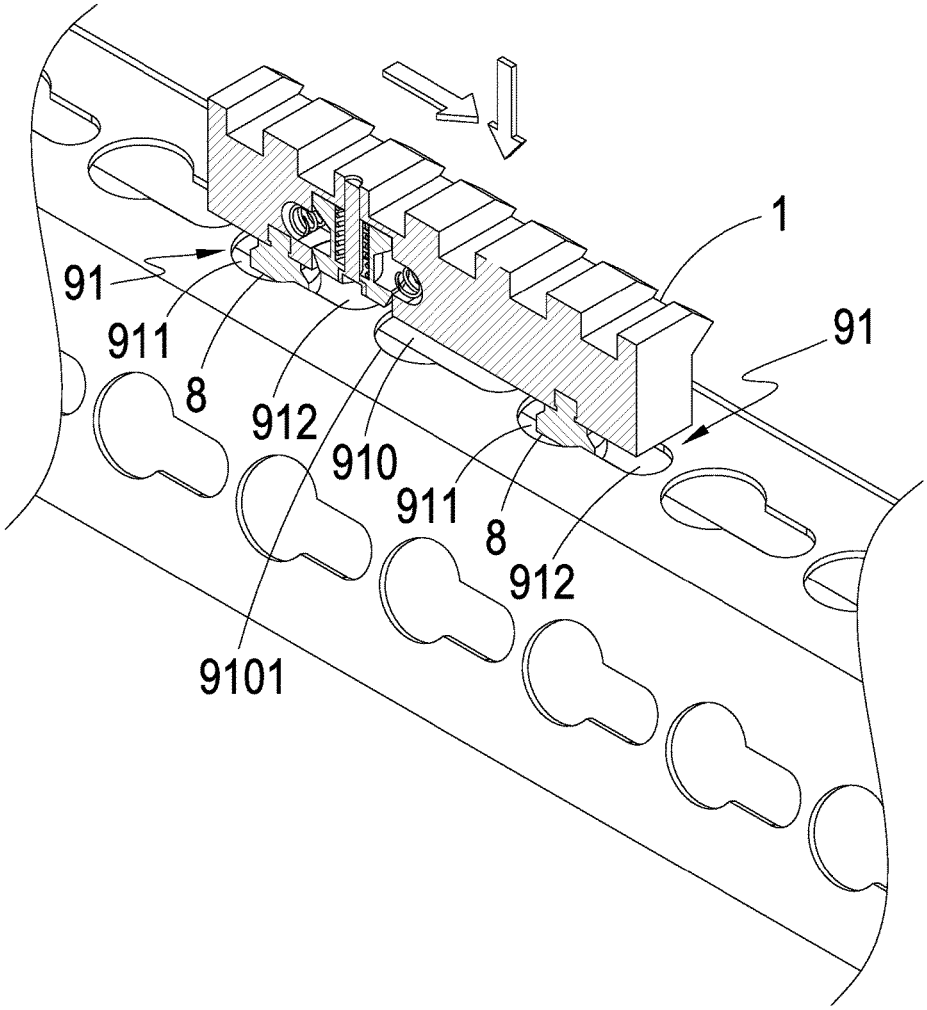
Figure 7:
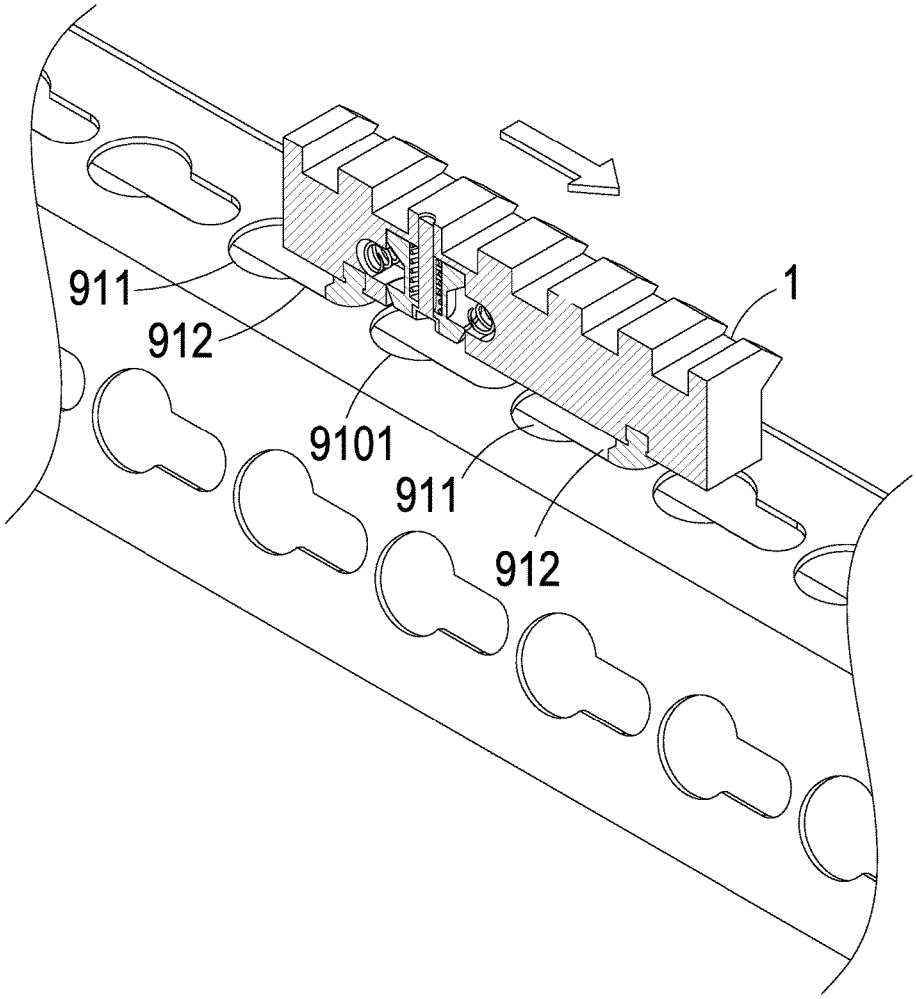
Figure 8:
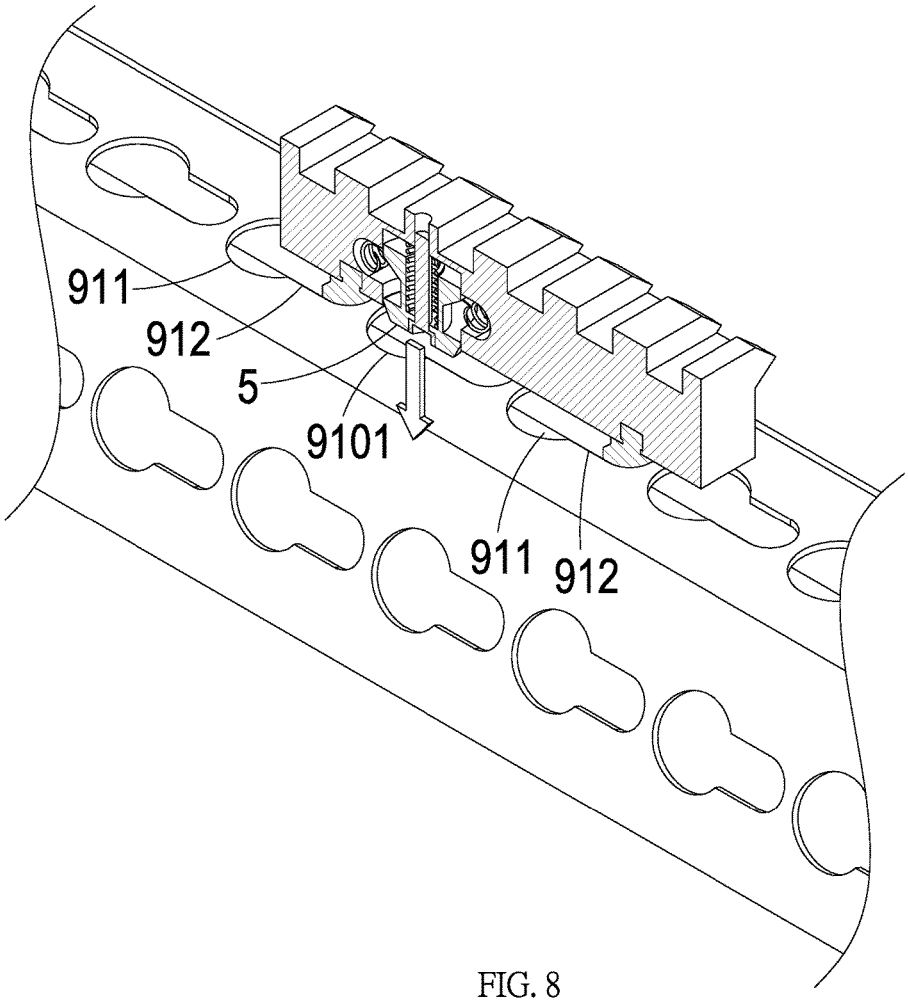
Figure 9:
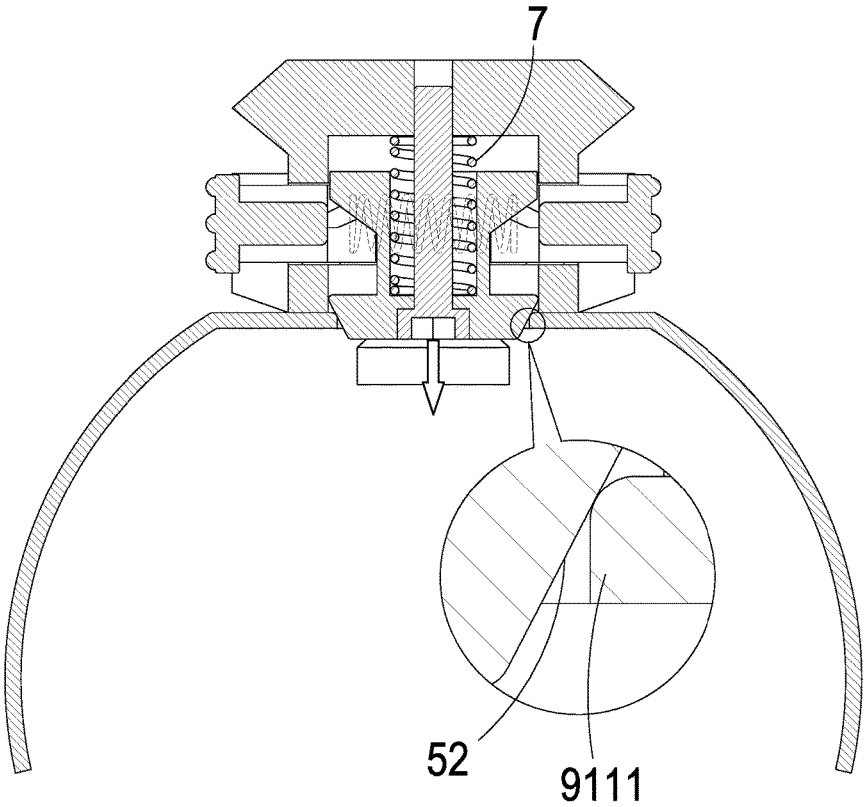

Referring to FIGS. 1 to 2, a KeyMod handguard quick release structure of the present invention includes:

a base body 1 for mounting gun accessories, having an accommodation space 11 with two through sides and a through hole 12 in communication with the accommodation space 11, and a fixing portion 14 allowing gun accessories to be attached;

a plurality of operation elements 3, configured movably in the accommodation space 11, each operation element 3 having at least one guide portion 32, a plurality of accepting portions 33 for the accommodation of respective first spring elements 4 mentioned below, and a plurality of tracks 34 allowing respective limit rods 2 to be moved thereon;

a plurality of first spring elements 4, two ends of each being fixed to the respective operation elements 3;

a positioning element 5, passed through the through hole 12, a first inclined face 51 operated in coordination with the guide portion 32 being formed on said positioning element 5, a second inclined face 52 operated in coordination and being in engagement with a KeyMod handguard on one side of the positioning element 5 far away from the first inclined face 51, a positioning rod 6 passed through a second spring element 7 mentioned below being passed through the positioning element 5, and the positioning element 5 being capable of moving inside the through hole 12 through the guide portion 32;

a second spring element 7, configured between the positioning element 5 and base body 1; and at least one engagement member 8, adapted to embed in the KeyMod hand guard and configured on a bottom of the base body 1, the engagement member including an inclined face-shaped arriving part 81.

Referring to FIGS. 1 to 9, the engagement member 8 is first placed in a large engagement hole 911 upon assembly, and the base body 1 is then pressed downward. At this time, the positioning element 5 will be moved upward immediately because it is limited by the surface of the KeyMod handguard 9. Thereafter, the base body 1 may then be moved toward a small engagement hole 912, and the positioning element 5 will be engaged automatically with the large engagement hole 911 to form a tight engagement state to press the KeyMod handguard 9 completely and tightly because of the pressing-downward of the second spring element 7 when the base body is moved to the edge of the small engagement hole 912, thereby completing the assembly of the KeyMod handguard 9 on the base body 1. Vice versa, upon the release of KeyMod handguard 9 from the base body 1, the operation element 3 is pressed to cause the first spring element to be compressed to deform by the operation element 3, while the guide portion 32 is in touch with the first inclined face 51 to cause the positioning element 5 to be lifted upward. At the same time, the second spring element 7 is thus compressed by the positioning element 5 to deform so that the positioning element 5 is thus lifted to the inside of the accommodation space 11 completely and no more engaged with the large engagement hole 911, while the engagement member 8 forms a passageway allowing the KeyMod handguard to be passed through so that the engagement member 8 can be moved in the large engagement hole 911, and the operation element 3 is then released and the base body 1 can be taken off. In another word, the first inclined face 51 being operated in coordination with the guide portion 32 to move vertically and the second inclined portion 52 being operated in coordination with the KeyMod handguard 9 make the positioning element 5 be engaged and fixed inside, thereby achieving a tight locking.

The combination of the engagement member 8 with the KeyMod handguard 9 will be described in detail as the following. The engagement member 8 includes an inclined face-shaped arriving portion 81. The thickness (tolerance) of the engagement hole 91 of the KeyMod handguard 9 is variant due to their manufacturers such that when the engagement member 8 is to be in engagement with the KeyMod handguard 9, the engagement member 8 is placed in the large engagement hole 911 and then pushed to the small engagement hole 912 to engage therewith. At this time, the engagement member 8 can be embedded in the small engagement hole 912 smoothly through the inclined face of the arriving portion 81, while the arriving portion 81 is blocked an limited by the hole edge of the small engagement hole 912. Thereupon, the arriving portion 81 can be suited to engage with engagement holes of different thicknesses due to the design of the inclined face thereof. In addition, the inclined face of the arriving portion 81 may be a spiral face.

The detail is further described for the engagement of the KeyMod handguard 9 mentioned above. The KeyMod handguard 9 has many engagement holes 91, and each engagement hole 91 is constituted by a large engagement hole 911 and small engagement hole 912 in communication with each other and sized differently. When the present invention carries out the engagement, the positioning element 5 will be pressed downward due to the second spring element 7 to cause the second inclined face 52 to be engaged with a hole edge 9101 of the large engagement hole 911 between the two front and rear large engagement holes 911 to a fixed state so that the base body 1 cannot be taken out vertically due to the engagement of the engagement member 8 with the small engagement hole 912, and the base body 1 cannot be moved laterally due to the configuration of the second inclined face 52 of the positioning element 5, thereby achieving a stable fixed state. In addition, the second inclined face 52 can be matched with the large engagement holes 911 of different sizes to carry out the positioning fixation thereof through the inclined face design. Briefly, the main fixation mode is using a plurality of engagement members 8 to be in engagement with a plurality of small engagement holes 912, and using the reverse force of the positioning element 5 to clip the large engagement hole 911, thereby achieving the effective fixation and positioning through the clipping reverse forces of the engagement member 8 and positioning element 5.

In addition, accessories can be fixed to the base body 1 effectively through the fixing portion 14.

Furthermore, the limiting rods 2 being operated in coordination with the tracks 34 can limit the range of motion of the operation element 3 when the operation elements 3 are moved so that it will never leave the actuation zone, and when the operation element 3 is subject to the outward spring force of the first spring element 4, the limiting rod 2 is used to prevent the operation element 3 from being sprung out of and separated from the base body 1.

Figure 10:
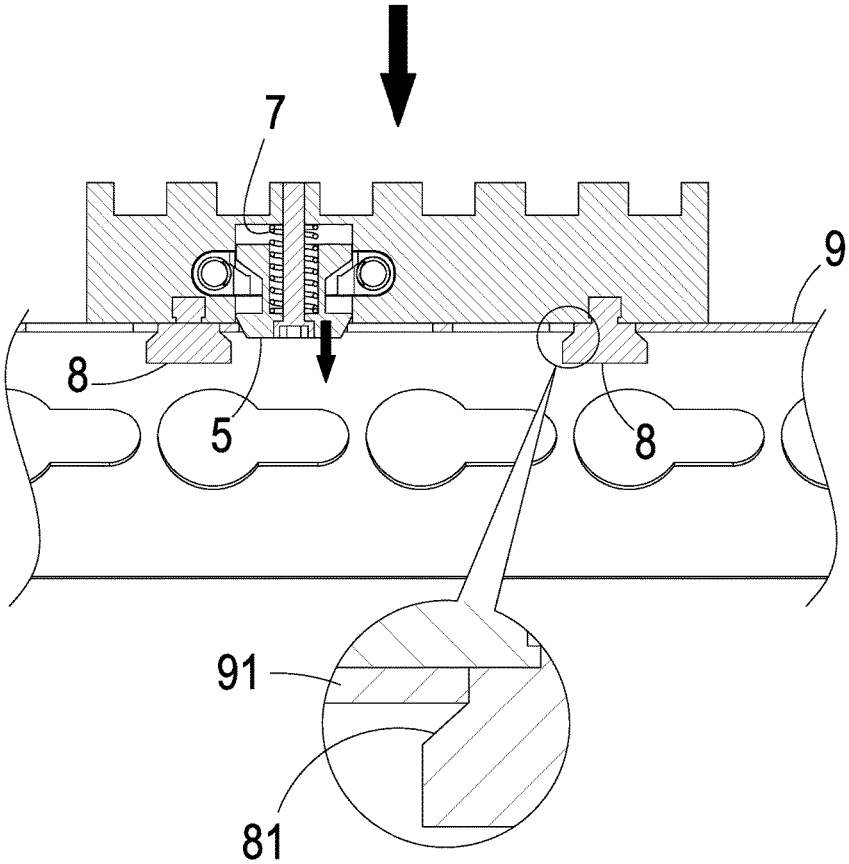
Figure 11:
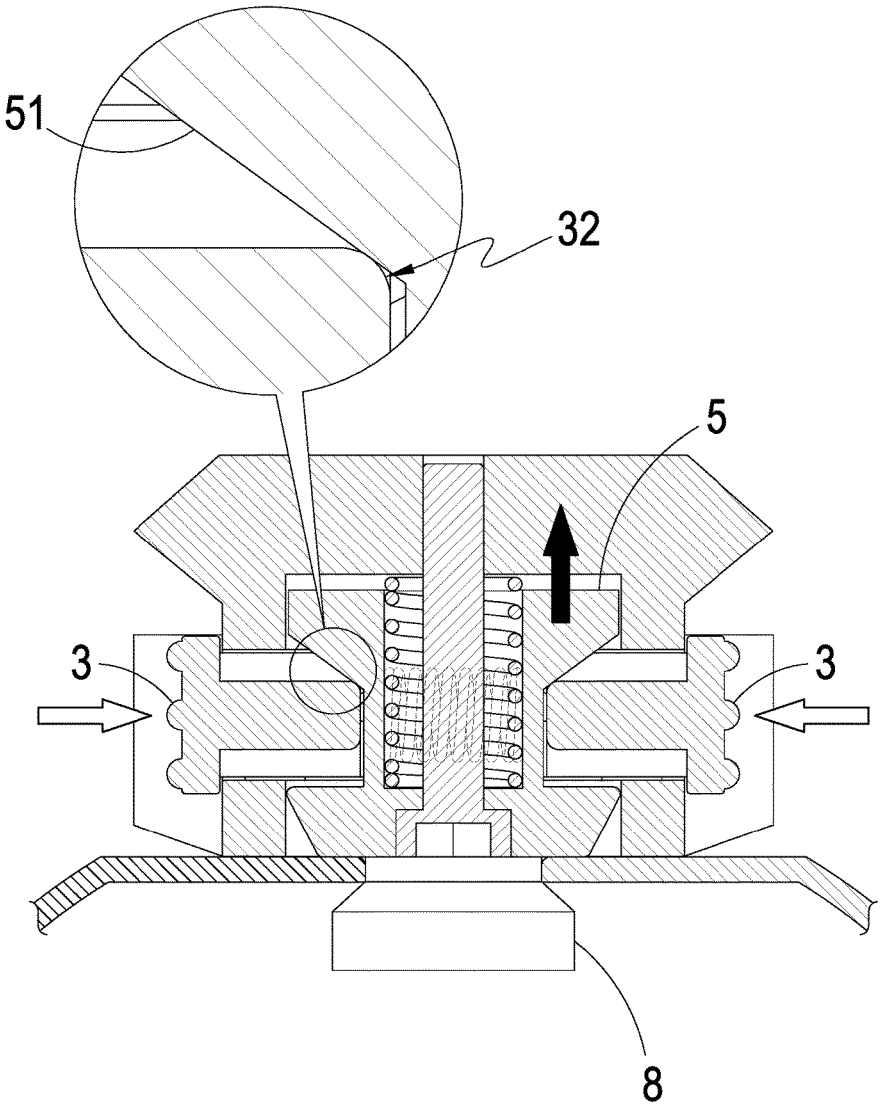
FIGS. 11 to 12, respectively, are a schematically cross-sectional view of the embodiment of the present invention in a release state.
Figure 12:
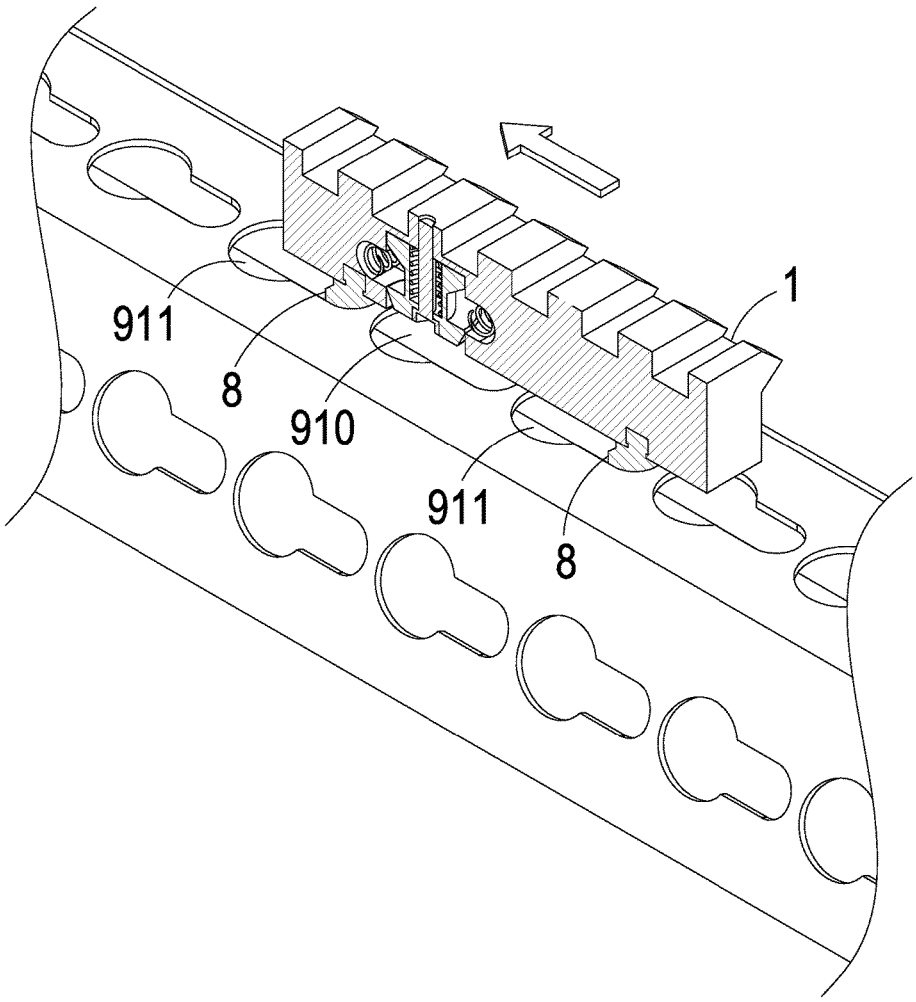

Referring to FIGS. 10 and 11, upon release, the operation elements 3 on the two sides of the base body 1 are pressed to cause the guide portions 32 of the operation elements 3 to compress the first inclined face 51 of the positioning element 5 to move the positioning element 5 upward by means of the design of the inclined faces. Thereafter, the base body 1 is not moved until the bottom of the positioning element 5 is higher than the upper surface of the large engagement hole 911, and the base body 1 can then be released when the engagement member 8 reaches the large engagement hole 911.

The operation element 3 being operated in coordination with the positioning element 5 allows the base body 1 to be compressed to position, and at the same time, the engagement member 8 being embedded in the KeyMod handguard allows the base body 1.

In Summary, the quick release structure of the present invention has the following advantages over the prior art:

1.) It can be fixed to and engaged with the KeyMod handguard smoothly and quickly.

2.) It can be released smoothly and quickly from the KeyMod handguard.

3.) It is a single-handed operation. No tools are needed.

1 base body
11 accommodation space
12 through hole
14 fixing portion
2 limit rod
3 operation element
32 guide portion
33 accepting portion
34 track
4 first spring element
5 positioning element
51 first inclined face
52 second inclined face
6 positioning rod
7 second spring element
8 engagement member
81 arriving portion
9 KeyMod handguard
91 engagement hole
910 large engagement hole
911 large engagement hole
9101 hole edge
912 small engagement hole

The invention claimed is:

1. A handguard quick release structure, comprising:

a base body for mounting gun accessories, having an accommodation space with two through sides and a through-hole in communication with said accommodation space;

a plurality of operation elements movably installed in said accommodation space, and each said operation element having at least one guide portion;

a plurality of first spring elements, two ends of each being fixed to said operation elements;

a positioning element, passed through said through hole, a first inclined face operated in coordination with said guide portion being formed thereon, said positioning element being capable of moving in said through-hole through said guide portion, and a second inclined face operated in coordination with and engaged with a handguard quick release structure being formed on one side of said positioning element distal said first inclined face;

a second spring element, configured between said positioning element and said base body; and at least one engagement member, configured on a bottom of said base body and adapted to embed in said handguard quick release structure, whereby, said first inclined face of said positioning element being operated in coordination with said guide portion to move vertically and said second inclined face being operated in coordination with said handguard quick release structure allow said base body to be engaged with and fixed to a large engagement hole of said handguard quick release structure so as to achieve a tight locking.

2. The structure according to claim 1, wherein said operation elements each has a plurality of accepting portions for receiving said first spring elements.

3. The structure according to claim 1, wherein said operation elements each has a plurality of tracks.

4. The structure according to claim 1, wherein a positioning rod is passed through said positioning element and said second spring element.

5. The structure according to claim 1, wherein a fixing portion adapted to be in combination with gun accessories is configured on said base body.

6. The structure according to claim 1, wherein said engagement member comprise an inclined face-shaped arriving portion.

7. The structure according to claim 3, wherein a limiting rod is movable in each said track.

* * * * *